US006796587B2

(12) United States Patent
Tsou

(10) Patent No.: US 6,796,587 B2
(45) Date of Patent: Sep. 28, 2004

(54) REFUSE COLLECTION DEVICE

(76) Inventor: Eric Tsou, 7F, No. 56, Lane 103, Sec. 2, Nei Hu Road, Taipei (TW)

( * ) Notice: Subject to any disclaimer, the term of this patent is extended or adjusted under 35 U.S.C. 154(b) by 0 days.

(21) Appl. No.: 10/277,804

(22) Filed: Oct. 23, 2002

(65) Prior Publication Data

US 2004/0080168 A1 Apr. 29, 2004

(51) Int. Cl.[7] ..... A01K 29/00; E01H 1/12

(52) U.S. Cl. ..... 294/1.4; 15/257.6

(58) Field of Search ..... 294/1.3–1.5, 19.1, 294/22, 24, 50.8, 50.9, 55, 115; 15/104.8, 257.1, 257.4, 257.6, 257.7; 119/161, 165

(56) References Cited

U.S. PATENT DOCUMENTS

| | | | | | |
|---|---|---|---|---|---|
| 4,148,513 | A | * | 4/1979 | Gagne | 294/1.4 |
| 4,225,174 | A | * | 9/1980 | Hennessy et al. | 294/1.4 |
| 5,320,393 | A | * | 6/1994 | Cortinas | 294/1.4 |
| 5,540,470 | A | * | 7/1996 | Lu | 294/1.4 |
| 5,671,959 | A | | 9/1997 | Tsou | |
| 5,820,179 | A | | 10/1998 | Tsou | |
| 6,019,405 | A | | 2/2000 | Tsou | |

* cited by examiner

*Primary Examiner*—Dean J. Kramer
(74) *Attorney, Agent, or Firm*—Birch, Stewart, Kolasch & Birch, LLP

(57) ABSTRACT

A refuse collection device includes an outer tube in which an inner tube is telescopically received. The outer tube is movable with respect to the inner tube between a lower closed position and an upper dumping position via an intermediate open position. A mount defining a refuse passage for the entry of a refuse is mounted to a lower end of the inner tube. A cover is rotatably connected to the mount by a pivot pin whereby the cover is movable with respect to the mount for selectively closing the refuse passage. A connection link couples the cover to the outer tube whereby the cover is rotated with respect to the mount when the outer tube is moved with respect to the inner tube between the upper, dumping position and the lower, closed position. A control device includes a first multi-stepped groove defined in an inside surface of the outer tube, radially extending holes defined in the inner tube and each movably receiving a spherical member and a shank movably and axially received in the inner tube and defining a second multi-stepped groove corresponding in position to the holes of the inner tube. The holes are positioned so that the spherical members are allowed to partially enter and engage the first and second multi-stepped grooves whereby the engagement between the spherical members and the first and second multi-stepped grooves allows the outer tube to be selectively retained at the lower, intermediate and upper positions with respect to the inner tube.

14 Claims, 5 Drawing Sheets

REFUSE COLLECTION DEVICE

FIELD OF THE INVENTION

The present invention relates generally to a refuse collection device for collecting refuse in a more sanitary manner, and in particular to a refuse collection device has a simple structure and reliable operation.

BACKGROUND OF THE INVENTION

Collecting refuses, especially animal droppings, is always a disgusting job. To help people collecting the refuses without using hand to directly pick up the refuses, there are a variety of refuse collection devices proposed and available in the market. One example of the known refuse collection devices is U.S. Pat. No. 6,019,405 issued to the applicant. Such a conventional device, although working well, has a complicated structure and requires a sophisticated operation, which makes it unreliable.

Thus, it is desired to have an improvement of the refuse collection device to overcome the above-discussed problems.

SUMMARY OF THE INVENTION

An object of the present invention is to provide a refuse collection device having a simple structure.

Another object of the present invention is to provide a refuse collection device having an easy and reliable operation.

A further object of the present invention is to provide a refuse collection device that can be manufactured with a simple process and having low costs.

To achieve the above objects, in accordance with the present invention, there is provided a refuse collection device comprising an outer tube in which an inner tube is telescopically received. The outer tube is movable with respect to the inner tube between a lower closed position and an upper dumping position via an intermediate open position. A mount defining a refuse passage for the entry of a refuse is mounted to a lower end of the inner tube. A cover is rotatably connected to the mount by a pivot pin whereby the cover is movable with respect to the mount for selectively closing the refuse passage. A connection link couples the cover to the outer tube whereby the cover is rotated with respect to the mount when the outer tube is moved with respect to the inner tube between the upper, dumping position and the lower, closed position via the intermediate open position. A control device includes a first multi-stepped groove defined. in an inside surface of the outer tube, radially extending holes defined in the inner tube and each movably receiving a spherical member and a shank movably and axially received in the inner tube and defining a second multi-stepped groove corresponding in position to the holes of the inner tube. The holes are positioned so that the spherical members are allowed to partially enter and engage the first and second multi-stepped grooves whereby the engagement between the spherical members and the first and second multi-stepped grooves allows the outer tube to be selectively retained at the lower, intermediate and upper positions with respect to the inner tube. A bag release is pivoted to the mount and is drivingly engageable by the cover when the cover is moved to the dumping position so as to tilt the bag release to release the refuse collection container from the mount.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will be apparent to those skilled in the art by reading the following description of a hot preferred embodiment thereof, with reference to the attached drawings, which are driven by way of illustration only, and thus are not limitative of the present invention, and in which.

DETAILED DESCRIPTION OF THE INVENTION

Figure 1:
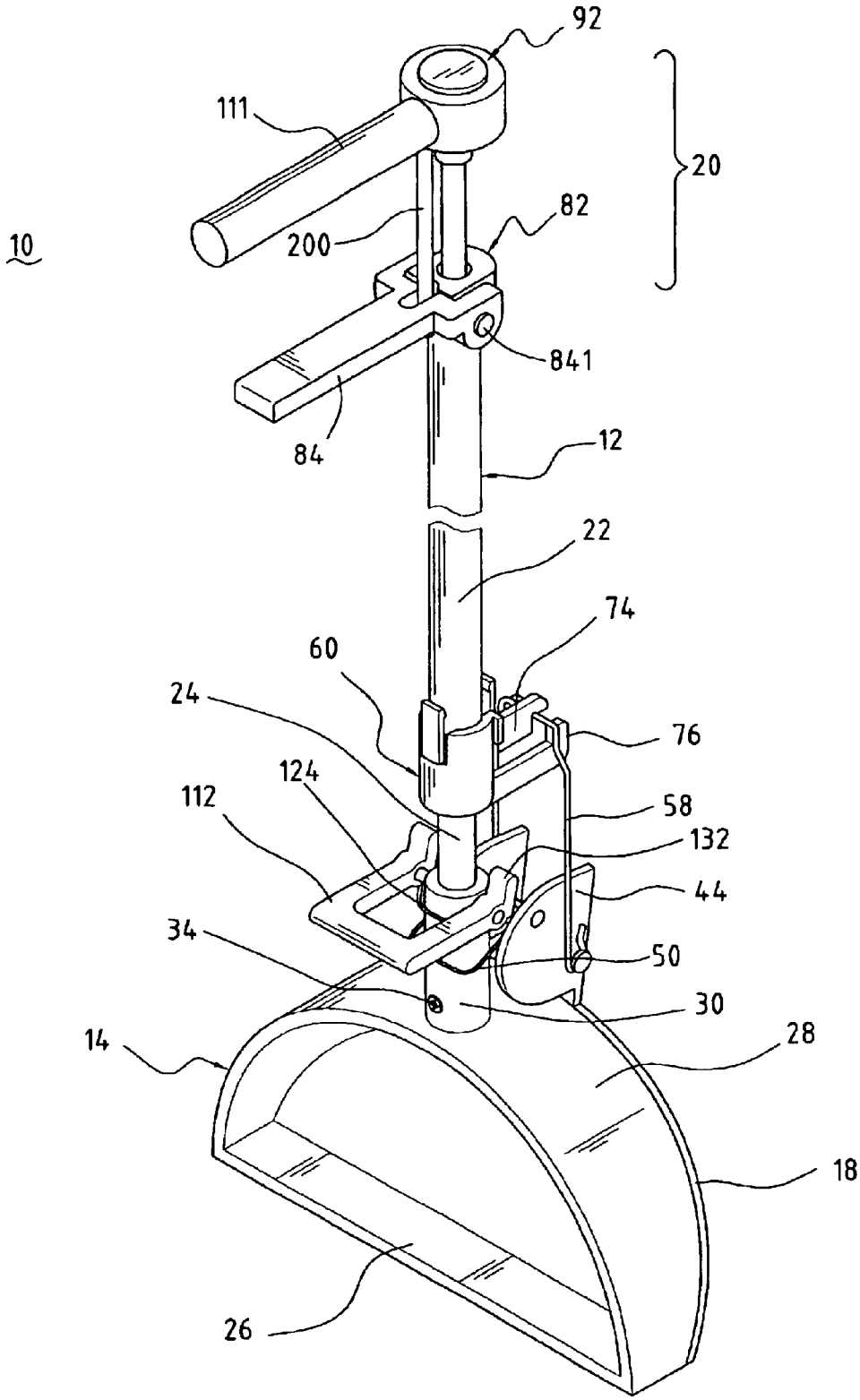
FIG. 1 is a perspective view of a refuse collection device constructed in accordance with the present invention.
Figure 2:
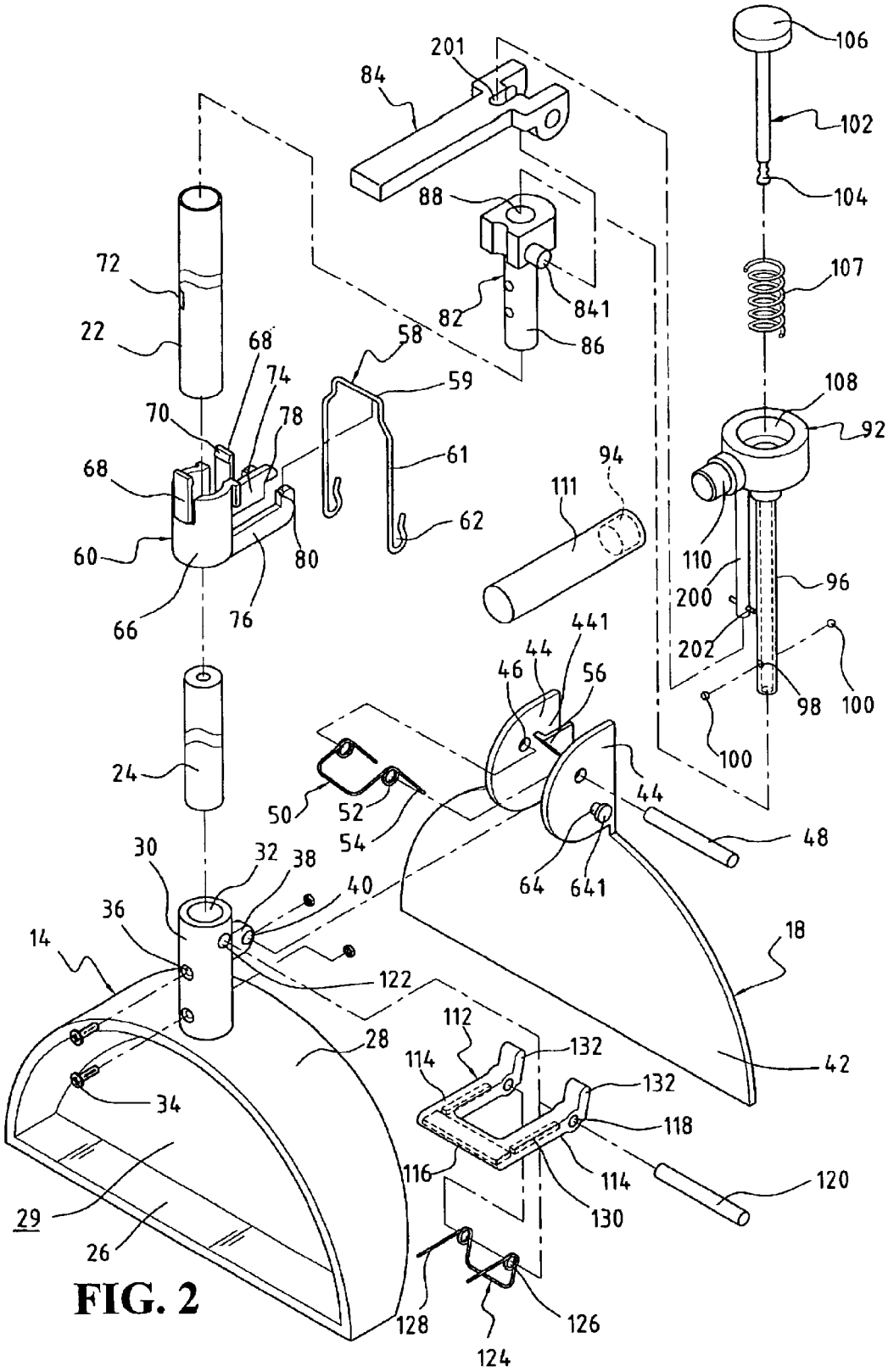
FIG. 2 is an exploded view of the refuse collection device of the present invention.
Figure 3:
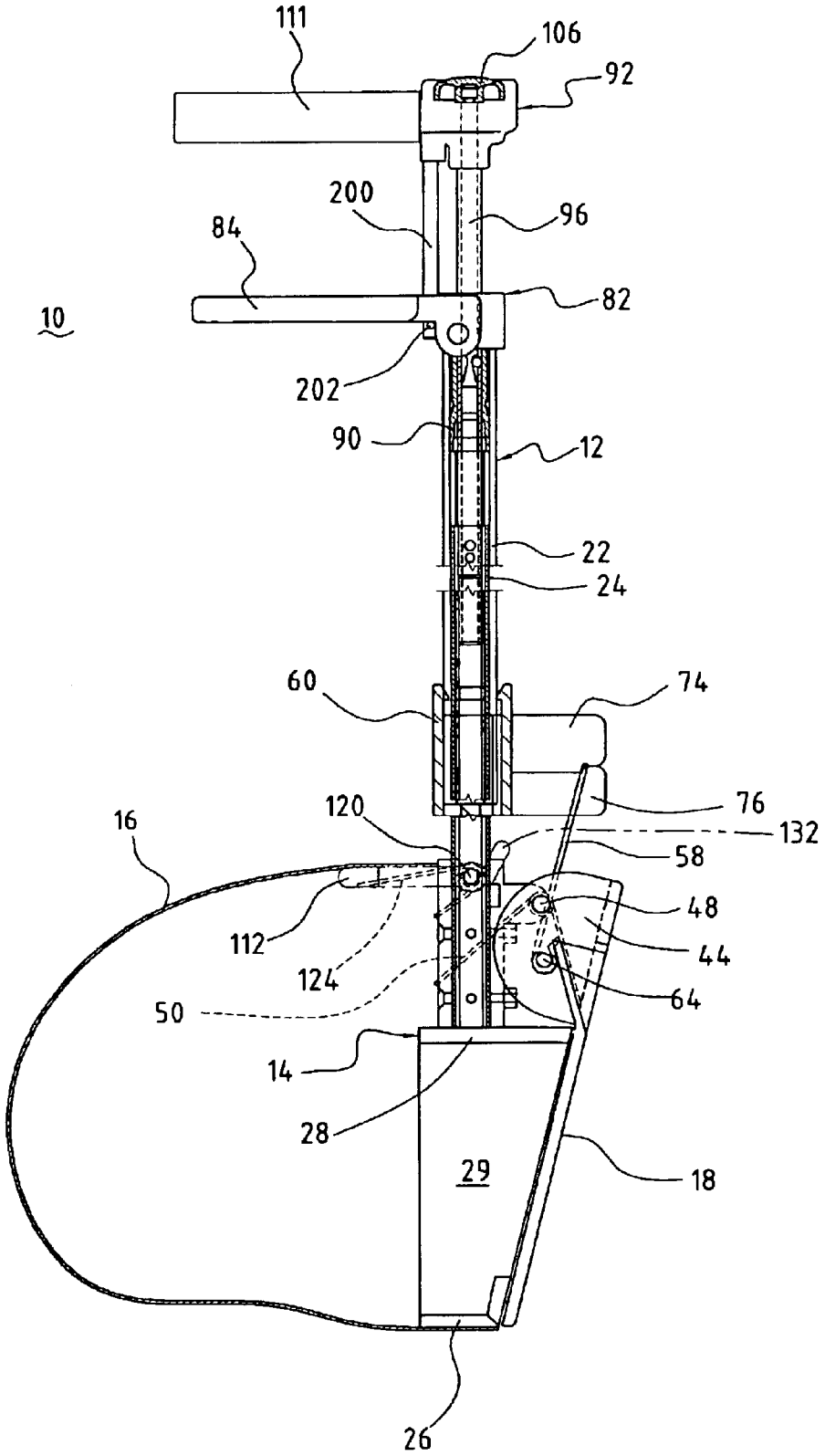
FIG. 3 is a side elevational view, partly sectioned, of the refuse collection device in a closed condition with a refuse collection container attached thereto.

With reference to the drawings and in particular to FIGS. 1–3, a refuse collection device constructed in accordance with the present invention, generally designated with reference numeral 10, comprises an elongated rod or tubular portion 12 which in general use is substantially upright with an axis thereof extending substantially vertically, having a lower end (not labeled) supporting a bag mount 14 to which a flexible refuse collection container 16, such as a plastic bag (FIGS. 3–5 only), is detachably mounted and openably closed by a cover 18 and an upper end (not labeled) to which a control 20 is mounted to selectively open the cover 18 for collecting refuse (not shown) into the refuse collection container 16.

Figure 4:
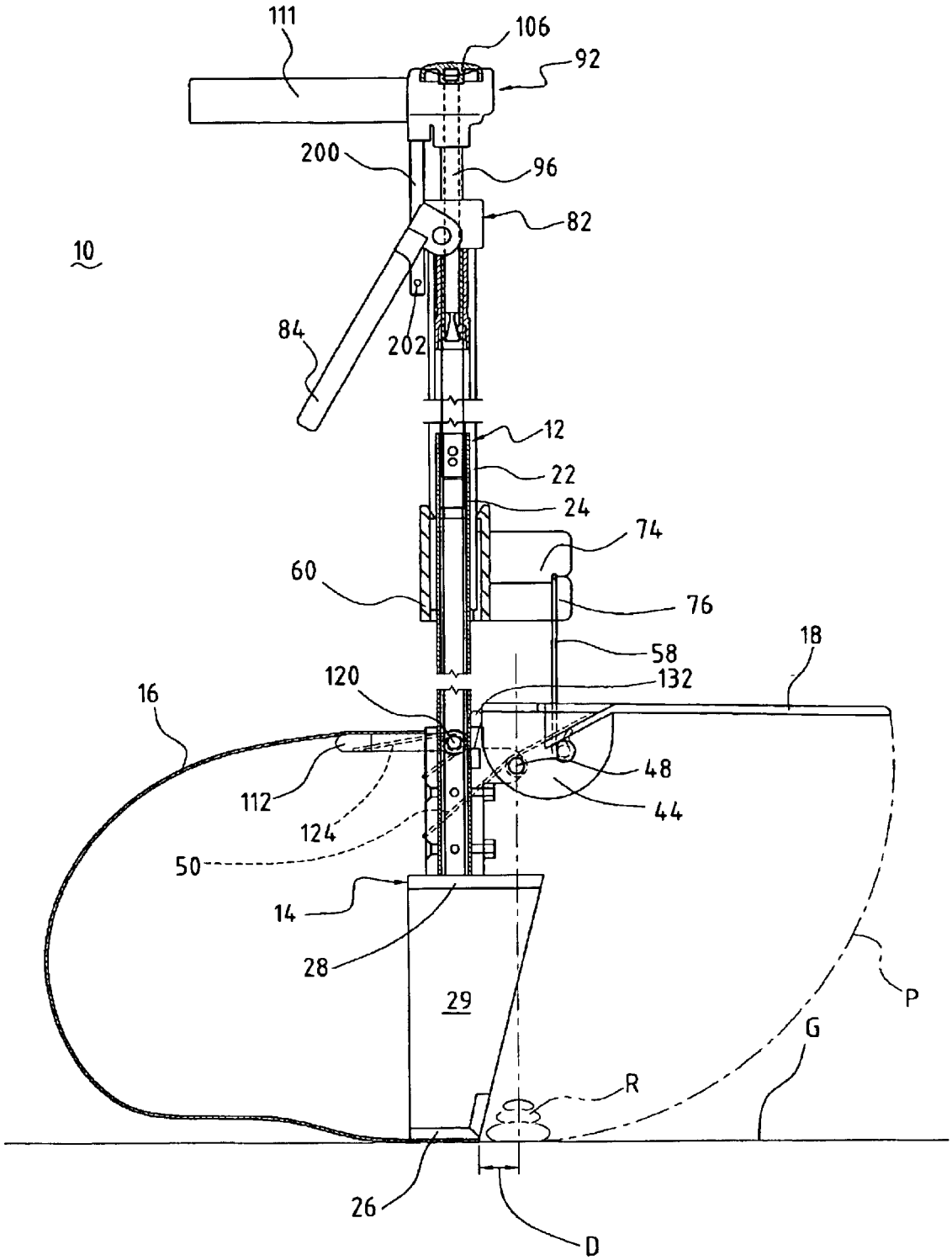
FIG. 4 is similar to FIG. 3 but showing the refuse collection device in an open condition.

The elongated rod portion 12 of the refuse collection device 10 comprises an outer tube 22 and an inner tube 24 telescopically received in the outer tube 22 whereby the outer tube 22 is axially movable with respect to the inner tube 24 between a lower closed position (FIG. 3) and an upper open position (FIG. 4). The outer tube 22 may be even moved to a dumping position (FIG. 5) beyond the upper open position. All these positions will be further discussed. Each of the tubes 22, 24 has an upper end and an opposite lower end. The lower end of the inner tube 24 extends beyond the lower end of the outer tube 22 with the bag mount 14 fixed thereto for supporting the refuse collection container 16.

The bag mount 14 comprises a semi-circular frame (not labeled) having a lower flat section 26 positionable on the ground G as shown in FIG. 4. For example, the bag mount 14 may be positioned in front of a refuse R, such as an animal dropping (shown in phantom lines in FIG. 4 for illustration purposes), and an are upper section 28 connected to the flat section 26 to define therebetween a refuse passage 29. The bag mount 14 comprises a hollow cylindrical projection 30 extending from the arc upper section 28 (preferably an upper apex thereof) in a vertically upward direction substantially perpendicular to the lower flat section 26. The projection 30 defines a central bore 32 into which the lower end of the inner tube 24 is inserted. The inner tube 24 is fixed to the projection 30 of the bag mount 14 by any known means, such as welding, or as shown in the drawings by means bolt-nut pairs 34 extending through holes 36 defined in the projection 30. A cover support 38 is formed on the projection 30 of the bag mount 14 and extends in a transverse direction. A through hole 40 is defined in the cover support 38.

The cover 18 comprises a semi-circular plate 42, substantially corresponding in shape and size to the semi-circular frame of the bag mount 14. The semi-circular plate 42 comprises two lugs 44 extending therefrom and spaced from each other. The lugs 44 define aligned holes 46 corresponding to the through hole 40 of the cover support 38 of the projection 30 of the bag mount 14 for the extension of a pivot pin 48 therethrough. This allows the cover 18 to rotate about the pivot pin 48 with respect to the bag mount 14 (as well as the projection 30) and thus making the semi-circular plate 42 of the cover 18 movable relative to the bag mount 14 between a closed position (FIG. 3) and an open position (FIG. 4) for closing/opening the refuse passage 29 defined between the upper section 28 and the lower section 26 of the bag mount 14.

A biasing element 50 is provided between the cover support 38 and the cover 18 to bias the cover 18 toward the closed position for normally closing the refuse passage 29 of the bag mount 14. The refuse passage 29 of the bag mount 14 is normally closed by the cover 18 under the biasing force of the biasing element 50 and can only be opened by manually moving the cover 18 against the biasing element 50 which will be further discussed. This prevents the refuse collected in the refuse collection container 16 that is mounted to the bag mount 14 from accidentally getting out of the refuse collection container 16 and causing a second time contamination.

In the embodiment illustrated, the biasing element 50 comprises a torsional spring, having a U-shaped configuration having two limbs connected by a bottom (both not labeled for simplifying the drawings). Each limb of the U-shaped configuration forms a coil 52 and has a free end 54. The pivot pin 48 of the cover 18 extends through the coils 52 for supporting and retaining the biasing element 50 in position. The bottom of the U-shaped configuration is attached to and supported by the projection 30 of the bag mount 14 and each free end 54 of the U-shaped configuration is fixed to the cover 18 by inserting into a slot 441 defined between each lug 44 and support plate 56 adjacent to and opposite to the lug 44 whereby the spring exerts the biasing force between the cover 18 and the cover support 38 of the bag mount 14.

A connection link 58, substantially U-shaped, has a bottom section 59 attached to the outer tube 22 by a retainer 60 and two side sections 61 each having a free end forming a hook 62 engaging a sideway-projecting pin 64 extending from each lug 44 of the cover 18 and having an expanded end 641. The connection link 58 allows the user to open the cover 18 by axially moving the outer tube 22 with respect to the inner tube 24 in an upward direction from the closed position to the open position. By moving the outer tube 22, the retainer 60 that is fixed to the outer tube 22, drives the cover 18, via the connection link 58, to rotate about the pivot pin 48 from the closed position to the open position for exposing the refuse passage 29 of the bag mount 14.

The retainer 60, which can be made of molded plastics, comprises a cylindrical body 66 snugly fit over the lower end of the outer tube 22. Two resilient fingers 68 are formed on opposite sides of the cylindrical body 66, each having a free end forming a barb 70 engaging a corresponding slot 72 defined in the outer tube 22 thereby attaching the retainer 60 to the outer tube 22. Upper and lower retaining boards 74, 76 extend transversely from the cylindrical body 66. Notches 78, 80 are defined in the upper and lower retaining boards 74, 76. In the embodiment illustrated, two lower boards 76 are provided and are spaced from each other with a single upper board 74 located above the lower boards 76 and at a position substantially midway between the lower boards 76. The notches 78, 80 of the upper and lower boards 74, 76 have arc configuration and are complementary to each other whereby the notches 78, 80 together, when viewed sideways, form a circular channel in which the bottom section 59 of the connection link 58 is accommodated. Thus, the bottom section 59 of the connection link 58 is seated in the notches 78, 80 whereby the bottom section 59 of the connection link 58 is gripped by and pinched between the upper and lower boards 74, 76. It is apparent to those having ordinary skills to replace the upper and lower boards 74, 76 with other structure to retain the bottom section 59 of the connection link 58.

The control 20 comprises a movable handle 82 mounted to the upper end of the outer tube 22 and a fixed handle 92 mounted to the upper end of the inner tube 24. The movable handle 82 comprises a handle bar 84 pivotally mounted to the movable handle 82 by a pivot 841 whereby the handle bar 84 is movable with respect to the movable handle 82 between a released condition and an erected condition where the handle bar 84 extends transversely from the movable handle 82. The movable handle 82 further comprises a cylindrical sleeve 86 mounted to the upper end of the outer tube 22 whereby the movable handle 82 is movable in unison with the outer tube 22. If desired, the sleeve 86 can be separated from the movable handle 82 and integrally formed with the outer tube 22. A central bore 88 is defined in the cylindrical sleeve 86. A multi-stepped groove 90 (FIG. 3) is defined in an inside surface (not labeled) of the bore 88 of the sleeve 86. The structure of the multi-stepped groove 90 is disclosed in detail in the above mentioned U.S. Pat. No. 6,019,405 and thus no further description will be given herein.

The fixed handle 92 comprises a handle bar 111 corresponding in spatial position to the handle bar 84 of the movable handle 82. Preferably, the handle bar 111 of the fixed handle 92 is detachably mounted to the fixed handle 92. For example and as illustrated in the drawings, a threaded extension 110 transversely extends from the fixed handle 92 and threadingly and thus detachably engages an inner threading 94 of the handle bar 111 to mount the handle bar 111 to the fixed handle 92 for allowing the user to hold the refuse collection device 10 in a direction facing a refuse R to be collected for best operation of the refuse collection device 10. A hollow shaft 96 extends from the handle 92 and is axially and movably received in the central bore 88 of the sleeve 86. The hollow shaft 96 has a lower end (not labeled) securely fixed to the upper end of the inner tube 24. (Alternatively, the hollow shaft 96 can be made an integral part of the inner tube 24.) The hollow shaft 96 is provided with a plurality of radially extending openings 98 around a circumference thereof to each movably receive a spherical member 100 whereby the spherical members 100 are allowed to partly move in and out of the multi-stepped groove 90 of the sleeve 86. The openings 98 are sized to allow the spherical members 100 to freely move therethrough. In the embodiment illustrated, there are two openings 98 formed on the shaft 96 and arranged to be diametrically opposite to each other.

The control 20 further comprises a shank 102 axially and movably received in the hollow shaft 96. The shank 102 forms a multi-stepped groove 104 formed on a lower end thereof and corresponding in position to the openings 98 of the hollow shaft 96. The structure and operation of the multi-stepped groove 104, as well as the spherical members 100 and the multi-stepped groove 90 of the sleeve 86, are disclosed and taught in the above-mentioned U.S. Pat. No. 6,019,405 and thus no further discussion is needed herein.

The shank 102 has an expanded upper end forming a pushbutton 106. The fixed handle 92 forms a recess 108 in an upper surface (not labeled) thereof for movably receiving the pushbutton 106 therein. Biasing means, such as helical spring 107, is disposed between the pushbutton 106 and the recess 108 for biasing the pushbutton 106 to a non-actuated position, which will be further discussed.

A driving link 200 extends downward from the fixed handle 92 and extends through a slot 201 defined in the movable handle bar 84 of the movable handle 82. Sideways projections 202 extend from a lower free end (not labeled) of the driving link 200 in opposite directions whereby when the outer tube 22 is moved to the lower position (FIG. 3), the projections 202 engage opposite sides of the slot 201 of the movable handle bar 84 and maintain the movable handle bar 84 at the erected condition to allow hand holding by the user for moving the outer tube 22 from the lower position toward the upper position and even the dumping position. When the outer tube 22 is moved to the upper position as shown in FIG. 4, the movable handle bar 84 is no longer supported by the projections 202 and is thus allowed to move to the released condition, clearing the space below the handle bar 111 of the fixed handle 92 for convenience of operation.

Figure 5:
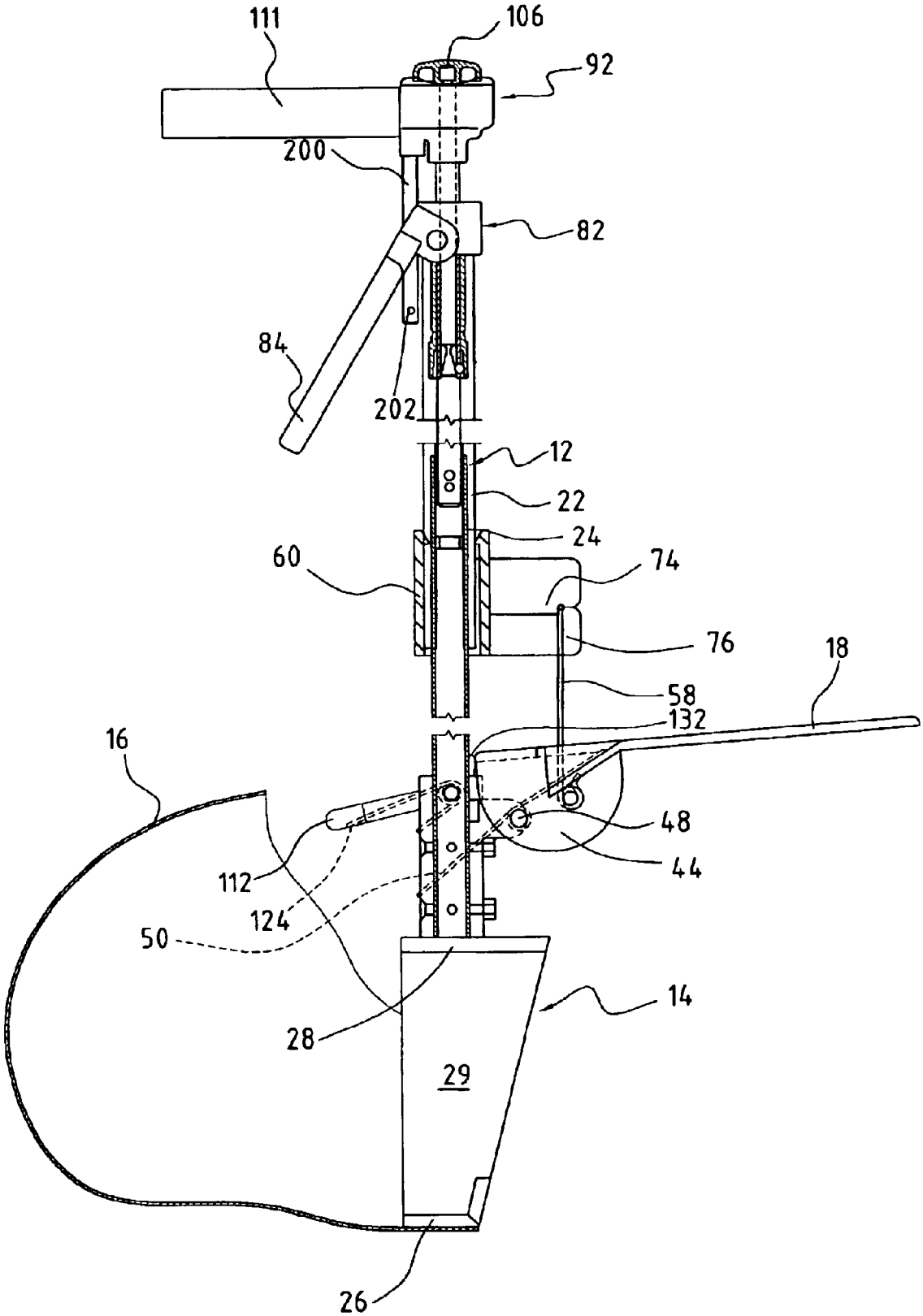
FIG. 5 is similar to FIGS. 3 and 4 but showing the refuse collection device in a dumping condition.

A bag release 112 is rotatably mounted to the projection 30 of the bag mount 14 substantially opposite to the cover 18. The bag release 112 has a U-shaped configuration having two spaced side sections 114 and a connection section 116 connected between the side sections 114. The side sections 114 are located on opposite sides of the projection 30 and define aligned holes 118 for receiving a pivot pin 120 which is mounted to the projection 30, such as extending through holes 122 defined in the projection 30, whereby the bag release 112 is movable with respect to the bag mount 14 between a bag-holding position (corresponding to the closed and open positions of the outer tube 22 and the cover 18 as shown in FIGS. 3 and 4) and a bag-releasing position (corresponding to the dumping position of the outer tube 22 and the cover 18 as shown in FIG. 5). In the bag-holding position, the connection section 116 of the bag release 112 is substantially horizontal, or even slightly upward inclined, for engaging and supporting an edge of the refuse collection container 16. The refuse collection container 16 is thus tightly fixed between the bag release 112 and the bag mount 14 (especially the flat section 26 of the bag mount 14). When the bag release 112 is moved to the bag-releasing position (in response to the movement of the outer tube 22 and the cover 18 toward the dumping position), the connection section 116 is slightly inclined downward, allowing the bag 16 to slip off of the bag release 112 and thus automatically removing the refuse collection container 16 from the refuse collection device 10.

A biasing element 124 is arranged between the bag release 112 and the bag mount 14 to bias the bag release 112 to the bag-holding position. The biasing element 124 comprises a U-shaped spring having two limbs each forming a coil 126 through which the pivot pin 120 extends for supporting and retaining the biasing element 124 in position. The limbs of the biasing element 124 has free end 128 received and retained in slots 130 defined in the side sections 114 of the bag release 112 for supporting and biasing the bag release 112 to the bag-holding position.

The side sections 114 of the bag release 112 have proximal ends 132. The ends 132 of the bag release 112 are located and dimensioned to be engageable by the lugs 44 of the cover 18 whereby when the cover 18 is moved from the open position to the dumping position, the lugs 44 thereof engage the ends 132 of the bag release 112 and initiate rotation of the bag release 112 with respect to the projection 30 of the bag mount 14, thereby tilting the bag release 112 to release the refuse collection container 16 from the bag mount 14.

Also referring to FIG. 4, to collect refuses, with the cover 18 opened, one may position the refuse collection device 10 next to the refuse R with the refuse passage 29 of the bag mount 14 facing the refuse R. To open the cover 18, one may move the movable handle 82 toward the fixed handle 92 whereby the cover 18 is driven by the outer tube 22 via the connection link 58 to the open position (FIG. 4). The outer tube 22 and thus the cover 18 are maintained in the open condition by the spherical members 100 engaging the multi-stepped grooves 90, 104 of the sleeve 86 and the shank 102. This is described in detail in the above-mentioned U.S. Pat. No. 6,019,405 and constitutes no novel part of the application. Thus, no detail regarding the operation of the spherical members 100, as well as the multi-stepped grooves 90, 104, is given herein.

Thereafter, by depressing the pushbutton 106 against the spring 107 from the non-actuated position to an actuated position, the shank 102 is forced downward and the engagement between the spherical members 100 and the multi-stepped grooves 90, 104 of the sleeve 86 and the shank 102 that maintains the cover 18 in the open position is broken. The cover 18 is driven back to the closed position by the biasing force of the biasing element 50. With the refuse R to be collected located in the path of the movement of the cover 18 when the cover 18 moves from the open position to the closed position, the cover 18 hits and scoops the refuse into the refuse collection container 16.

To dispose the collected refuse, the refuse collection container 16 is detached from the bag mount 14 without the user's hand(s) directly touching the refuse collection container 16. This is done by manually moving the movable handle 82 toward the fixed handle 92 with the cover 18 moving from the closed position and passing the open position and toward the dumping position as shown in FIG. 5. The bag release 112 that supports the refuse collection container 16 on the bag mount 14 is tilted thereby releasing the refuse collection container 16 from the bag mount 14.

The bag release 112 and the cover 18 are maintained in the dumping position by the spherical members 100 as described in the above mentioned U.S. Pat. No. 6,019,405. To release the cover 18 from the dumping position shown in FIG. 5, one may simply depress the pushbutton 106 to move the shank 102 downward so as to break the engagement between the spherical members 100 and the grooves 90, 104 that maintains the cover 18 in the dumping position. The cover 18 is now allowed to move downward along the arc path P (FIG. 4) and thus closing the cover 18.

Referring back to FIGS. 3–5, the bag mount 14 has an inclined side profile whereby the flat section 26 of the bag mount 14 is spaced from a position corresponding to the pivot pin 48 of the cover 18 in the vertical direction and a distance D therebetween is sufficient to provide a space for accommodating the refuse R to be collected at a position substantially corresponding to the pivot pin 48 of the cover 18 in the vertical direction. This allows the refuse R to be positioned at the lowermost point of the path P of the cover 18 whereby the cover 18 hits the refuse R with the greatest speed that the cover 18 in a most complete way because the cover 18 has the lowest potential energy at the position corresponding to or vertically aligned with the pivot pin 48 and thus the greatest kinematical energy, giving the greatest speed.

In addition, since the refuse R is located at the lowermost point of the path P of the cover 18, the cover 18 can hit almost all of the refuse R to completely move the refuse R into the container 16.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A refuse collection device comprising:

an inner tube having upper and lower ends;

an outer tube having upper and lower ends, the outer tube being telescopically fit over and axially movable with respect to the inner tube between a lower closed position and an upper dumping position via an intermediate open position;

a mount fixed to the lower end of the inner tube and defining a refuse passage for entry of a refuse;

a cover rotatably connected to the mount by a pivot pin whereby the cover is movable with respect to the mount for selectively closing the refuse passage;

a connection link coupling the cover to the outer tube whereby the cover is rotated with respect to the mount when the outer tube is moved with respect to the inner tube between the upper, open position and the lower, closed position;

a control device comprising a first multi-stepped groove defined in an inside surface of the outer tube, at least one hole defined in the inner tube and movably receiving a spherical member therein, the hold being positioned so that the spherical member is allowed to partially enter the first multi-stepped groove of the outer tube, a shank movably and axially received in the inner tube and defining a second multi-stepped groove corresponding in position to the hole of the inner tube whereby the spherical member is allowed to partially enter the second multi-stepped groove, wherein engagement between the spherical member and the first and second multi-stepped grooves allows the outer tube to be selectively retained at the lower, intermediate and upper positions with respect to the inner tube; and a retainer having a cylindrical body fit over the lower end of the outer tube and being secured to the outer tube by at least one finger which is engaged in a corresponding slot on the outer tube, the retainer receiving a portion of the connection link to secure the connection link to the outer tube.

2. The refuse collection device as claimed in claim 1, wherein the mount comprises a lower section adapted to be positioned on the ground and an upper section mounted on the lower section to define the refuse passage therebetween, the lower section being spaced from a position corresponding to the pivot pin of the cover in a vertical direction a first distance for accommodating a refuse to be collected by the refuse collection device substantially at the position corresponding to the pivot pin of the cover in the vertical direction.

3. The refuse collection device as claimed in claim 1, wherein the cover is biased by a biasing element toward the closed position.

4. The refuse collection device as claimed in claim 1, wherein the retainer has a cylindrical body fit over the lower end of the outer tube and wherein the at least one finger comprises two resilient fingers having barbed ends, the outer tube having corresponding slots and the two fingers engaging the slots defined in the outer tube to secure the retainer to the outer tube, upper and lower securing boards transversely extending from the retainer for pinchingly receiving the portion of the connection link therebetween thereby securing the connection link to the outer tube.

5. The refuse collection device as claimed in claim 1, wherein the retainer is made of molded plastics.

6. The refuse collection device as claimed in claim 1, further comprising a fixed handle having a first transversely extending handle bar mounted to the upper end of the inner tube for hand-holding by a user.

7. The refuse collection device as claimed in claim 6, further comprising a movable handle mounted to the upper end of the outer tube to be movable therewith, the movable handle comprising a second handle bar that is pivotally connected to the movable handle whereby the second handle bar is movable between a released condition and an erected condition where the second handle bar extends transversely with respect to the outer tube, a driving link depending from the fixed handle and extending through a slot formed in the second handle bar and defined by opposite side walls, sideways projections being formed on the driving link whereby when the outer tube is moved to the lower position, the sideway projections engage the side walls of the slot of the second handle bar and support the second handle bar in the erected condition.

8. The refuse collection device as claimed in claim 6, wherein the fixed handle comprises an additional handle bar adapted to be hand held for positioning the mount facing a refuse to be collected.

9. The refuse collection device as claimed in claim 6, wherein the fixed handle defines a bore for receiving the shank in the inner tube.

10. The refuse collection device as claimed in claim 1, further comprising a bag release pivotally mounted to the inner tube, the bag release comprising a first portion spaced from the bag mount and being spring-biased for supporting a flexible refuse collection container, in an expanded condition, between the first portion of the bag release and the bag mount.

11. The refuse collection device as claimed in claim 10, wherein the bag release further comprises a second portion engageable by the cover when the cover is moved to the dumping position so as to tilt the first portion of the bag release for releasing the collection container from the bag mount.

12. A device for collecting a refuse comprising:

an upright rod assembly;

a bag mount attached to a lower end of the rod assembly; and a cover pivotally mounted to the bag mount by a pivot and rotatable with respect to the bag mount between first and second positions;

a bag release pivotally mounted to the bag mount and movable between a bag-holding position and a bag-releasing position, the bag release comprising a first portion spaced from the bag mount and being spring biased toward the bag-holding position to support a flexible refuse collection bag in an expanded condition between the bag release and the bag mount for receiving a refuse, the bag release further comprising a second portion engageable by the cover when the cover is moved from the first position to the second position thereby driving the first portion from the bag-holding position to the bag-releasing position where the first portion of the bag release no longer supports the bag in the expanded condition thereby allowing the bag to freely separate from the bag release.

13. The device as claimed in claim 12, wherein the first portion of the bag release comprises a U-shaped member having two side sections connected by a bottom section, the side sections being located on opposite sides of a projection of the bag mount and pivoted thereto by a pivot for engaging the bag, each side section having an end extension located on opposite side of the projection with respect to the bottom section, the end extension being engageable by the cover for being driven by the cover against the biasing spring from the bag-holding position to the bag-releasing position.

14. The device as claimed in claim 12, wherein the biasing spring comprises a U-shaped spring having two limbs each forming a coil encompassing the pivot and thus supported thereby, each limb having a free end received in and engaged by a slot defined in the corresponding side section of the bag release, the U-shaped spring further comprising a bottom attached to the projection of the bag mount.

* * * * *